US005207343A

United States Patent [19]

Bogadi

[11] Patent Number: 5,207,343

[45] Date of Patent: May 4, 1993

[54] PRESENT INVENTION REFERS TO A NEW SYSTEM OF MODULAR KNOCK-DOWN PACKAGING

[76] Inventor: Cesar Bogadi, 301 W. 110th St., New York, N.Y. 10026

[21] Appl. No.: 734,212

[22] Filed: Jul. 22, 1991

[30] Foreign Application Priority Data

May 29, 1991 [ES] Spain ..... 9101300

[51] Int. Cl.[5] ..... B65D 7/24

[52] U.S. Cl. ..... 220/4.28; 220/681; 217/12 R

[58] Field of Search ..... 220/1.5, 4.28, 4.33, 220/4.03, 681, 692, 693, 4.28, 4.33, 4.03; 217/12 R, 43 R

[56] References Cited

U.S. PATENT DOCUMENTS

| | | | |
|---|---|---|---|
| 672,241 | 4/1901 | Stroop | 217/12 R |
| 2,578,644 | 12/1951 | Mautner | 220/681 X |
| 2,781,902 | 2/1957 | Smithers | 206/65 |
| 2,960,249 | 11/1960 | Walsh | 220/4.28 X |
| 3,306,487 | 2/1967 | Gregoire | 220/1.5 |
| 3,311,231 | 3/1967 | English | 206/65 |
| 3,342,364 | 9/1967 | Bingham et al. | 217/12 R X |
| 3,371,816 | 3/1968 | Ricci | 220/4 |
| 3,374,915 | 3/1968 | Verhein et al. | 220/4.33 X |
| 3,561,633 | 2/1971 | Morrison | 220/1.5 |
| 3,618,803 | 11/1971 | Dobberkav | 220/1.5 |
| 3,809,278 | 5/1974 | Csumrik | 220/4 F |
| 3,877,602 | 4/1975 | Clark | 220/4.33 X |
| 3,885,701 | 5/1975 | Becklin | 220/681 X |
| 3,955,320 | 5/1976 | Serovy | 217/12 R X |
| 3,985,258 | 10/1976 | Quigley | 220/4.33 X |
| 4,000,827 | 1/1977 | Emery | 220/4.28 |
| 4,184,602 | 1/1980 | Moliard | 220/4 C |
| 4,194,642 | 3/1980 | Glavan | 220/4.28 X |
| 4,699,282 | 10/1987 | Farrar | 215/12 A |
| 4,730,746 | 3/1988 | Yankoff | 220/4 F |
| 4,741,449 | 5/1988 | Bersani | 220/1.5 |
| 4,752,861 | 6/1988 | Niggl | 361/383 |
| 4,828,115 | 5/1989 | Wiegand | 206/576 |
| 4,948,005 | 8/1990 | Garton | 220/1.5 |
| 5,076,454 | 12/1991 | Garton et al. | 220/4.28 X |

OTHER PUBLICATIONS

Newsletter, Jul. 1, 1991, of the National Wooden Pallet and Container Association, vol. 91, No. 12.

Newsletter, Jul. 15, 1991 of the National Wooden Pallet and Container Association, vol. 91 No. 13.

Hafele Corporation–excerpts from 1987 catalog entitled "The Minifix System of Knock-Down Fittings Based on 'centric sphere principle'", including five pages for Minifix 15 Knock Down Fittings (pages unnumbered).

*Primary Examiner*—Steven M. Pollard

*Attorney, Agent, or Firm*—Kuhn and Muller

[57] ABSTRACT

A modular knock-down packing container system, generally of wood, includes interchangeable wall panels with corresponding channel guides for guaranteeing the structurally reinforcement and sealing of the interchangeable walls. The panels are held in place by a combination of the position of the panels within corresponding channel guides and of the use of central sphere rod connectors, which connectors may be rapidly and easily loosened for dismantling of the packaging system, so that the panels can be re-used in other configurations. A systematic plurality of wall panels is provided with incremental dimensioned variations, so that the size of the containers can be varied while preserving the ability to create large hollow interiors uninterrupted by perpendicular floor members. Expansion of the size of the containers is also accomplished without limiting interior container storage space by axial connection of the stacking of the panels end over end. The joints between successive layers of axially connected panels may be reinforced by overlapping strip elements connected in a like manner to the panels are the panels are connected to themselves by the central sphere rod connectors.

24 Claims, 11 Drawing Sheets

| | | EQUIVALENCES 32MM | | | | | | |
|---|---|---|---|---|---|---|---|---|
| L= | | 25.40 | | | | | | |
| 32 | MM | | NL | MM | | NL | MM | |
| 0.5 | 16 | 0.63 | 30.5 | 976 | 38.43 | 60.5 | 1936 | 76.22 |
| 1 | 32 | 1.26 | 31 | 992 | 39.06 | 61 | 1952 | 76.85 |
| 1.5 | 48 | 1.89 | 31.5 | 1008 | 39.69 | 61.5 | 1968 | 77.48 |
| 2 | 64 | 2.52 | 32 | 1024 | 40.31 | 62 | 1984 | 78.11 |
| 2.5 | 80 | 3.15 | 32.5 | 1040 | 40.94 | 62.5 | 2000 | 78.74 |
| 3 | 96 | 3.78 | 33 | 1056 | 41.57 | 63 | 2016 | 79.37 |
| 3.5 | 112 | 4.41 | 33.5 | 1072 | 42.20 | 63.5 | 2032 | 80.00 |
| 4 | 128 | 5.04 | 34 | 1088 | 42.83 | 64 | 2048 | 80.63 |
| 4.5 | 144 | 5.67 | 34.5 | 1104 | 43.46 | 64.5 | 2064 | 81.26 |
| 5 | 160 | 6.30 | 35 | 1120 | 44.09 | 65 | 2080 | 81.89 |
| 5.5 | 176 | 6.93 | 35.5 | 1136 | 44.72 | 65.5 | 2096 | 82.52 |
| **6** | **192** | **7.56** | **36** | **1152** | **45.35** | **66** | **2112** | **83.15** |
| 6.5 | 208 | 8.19 | 36.5 | 1168 | 45.98 | 66.5 | 2128 | 83.78 |
| 7 | 224 | 8.82 | 37 | 1184 | 46.61 | 67 | 2144 | 84.41 |
| 7.5 | 240 | 9.45 | 37.5 | 1200 | 47.24 | 67.5 | 2160 | 85.04 |
| 8 | 256 | 10.08 | 38 | 1216 | 47.87 | 68 | 2176 | 85.67 |
| 8.5 | 272 | 10.71 | 38.5 | 1232 | 48.50 | 68.5 | 2192 | 86.30 |
| 9 | 288 | 11.34 | 39 | 1248 | 49.13 | 69 | 2208 | 86.93 |
| 9.5 | 304 | 11.97 | 39.5 | 1264 | 49.76 | 69.5 | 2224 | 87.56 |
| 10 | 320 | 12.60 | 40 | 1280 | 50.39 | 70 | 2240 | 88.19 |
| 10.5 | 336 | 13.23 | 40.5 | 1296 | 51.02 | 70.5 | 2256 | 88.82 |
| 11 | 352 | 13.86 | 41 | 1312 | 51.65 | 71 | 2272 | 89.45 |
| 11.5 | 368 | 14.49 | 41.5 | 1328 | 52.28 | 71.5 | 2288 | 90.08 |
| **12** | **384** | **15.12** | **42** | **1344** | **52.91** | **72** | **2304** | **90.71** |
| 12.5 | 400 | 15.75 | 42.5 | 1360 | 53.54 | 72.5 | 2320 | 91.34 |
| 13 | 416 | 16.38 | 43 | 1376 | 54.17 | 73 | 2336 | 91.97 |
| 13.5 | 432 | 17.01 | 43.5 | 1392 | 54.80 | 73.5 | 2352 | 92.60 |
| 14 | 448 | 17.64 | 44 | 1408 | 55.43 | 74 | 2368 | 93.23 |
| 14.5 | 464 | 18.27 | 44.5 | 1424 | 56.06 | 74.5 | 2384 | 93.86 |
| 15 | 480 | 18.90 | 45 | 1440 | 56.69 | 75 | 2400 | 94.49 |
| 15.5 | 496 | 19.53 | 45.5 | 1456 | 57.32 | 75.5 | 2416 | 95.12 |
| 16 | 512 | 20.16 | 46 | 1472 | 57.95 | 76 | 2432 | 95.75 |
| 16.5 | 528 | 20.79 | 46.5 | 1488 | 58.58 | 76.5 | 2448 | 96.38 |
| 17 | 544 | 21.42 | 47 | 1504 | 59.21 | 77 | 2464 | 97.01 |
| 17.5 | 560 | 22.05 | 47.5 | 1520 | 59.84 | 77.5 | 2480 | 97.64 |
| **18** | **576** | **22.68** | **48** | **1536** | **60.47** | **78** | **2496** | **98.27** |
| 18.5 | 592 | 23.31 | 48.5 | 1552 | 61.10 | 78.5 | 2512 | 98.90 |
| 19 | 608 | 23.94 | 49 | 1568 | 61.73 | 79 | 2528 | 99.53 |
| 19.5 | 624 | 24.57 | 49.5 | 1586 | 62.44 | 79.5 | 2544 | 100.16 |
| 20 | 640 | 25.20 | 50 | 1600 | 62.99 | 80 | 2560 | 100.79 |
| 20.5 | 656 | 25.83 | 50.5 | 1616 | 63.62 | 80.5 | 2576 | 101.42 |
| 21 | 672 | 26.46 | 51 | 1632 | 64.25 | | | |
| 21.5 | 688 | 27.09 | 51.5 | 1648 | 64.88 | | | |
| 22 | 704 | 27.72 | 52 | 1664 | 65.51 | | | |
| 22.5 | 720 | 28.35 | 52.5 | 1680 | 66.14 | | | |
| 23 | 736 | 28.98 | 53 | 1696 | 66.77 | | | |
| 23.5 | 752 | 29.61 | 53.5 | 1712 | 67.40 | | | |
| **24** | **768** | **30.24** | **54** | **1728** | **68.03** | | | |
| 24.5 | 784 | 30.87 | 54.5 | 1744 | 68.66 | | | |
| 25 | 800 | 31.50 | 55 | 1760 | 69.29 | | | |
| 25.5 | 816 | 32.13 | 55.5 | 1776 | 69.92 | | | |
| 26 | 832 | 32.76 | 56 | 1792 | 70.55 | | | |
| 26.5 | 848 | 33.39 | 56.5 | 1808 | 71.18 | | | |
| 27 | 864 | 34.02 | 57 | 1824 | 71.81 | | | |
| 27.5 | 880 | 34.65 | 57.5 | 1840 | 72.44 | | | |
| 28 | 896 | 35.28 | 58 | 1856 | 73.07 | | | |
| 28.5 | 912 | 35.91 | 58.5 | 1872 | 73.70 | | | |
| 29 | 928 | 36.54 | 59 | 1888 | 74.33 | | | |
| 29.5 | 944 | 37.17 | 59.5 | 1904 | 74.96 | | | |
| **30** | **960** | **37.80** | **60** | **1920** | **75.59** | | | |

FIG. 11

PRESENT INVENTION REFERS TO A NEW SYSTEM OF MODULAR KNOCK-DOWN PACKAGING

BACKGROUND OF THE INVENTION

It is know that, even before the industrial revolution, packing and product protection was a serious problem, solved more or less successfully.

Currently, packing is a very important industrial sector, without which safe and efficient local and international trade would not be possible.

However, under the current technical conditions and in certain specific sectors, there are severe deficiencies concerning packing, while in other sectors which develop new products, innovative packing systems are in constant demand.

The main shortcomings of current packing techniques are described below:

1) The use of packing material still is a rather unimportant topic worldwide, stimulating the waste of raw materials and forest resources, such as wood.

2) In sectors such as the industries manufacturing medical equipment, measurement instruments, electronic equipment, laboratory equipment, computers, etc., almost all packing materials are made of wood, which requires such factories to have affiliates designing and manufacturing such packing materials. These packing materials are used for transport between manufacturer and user, and then are destroyed, since their construction is traditional, using nails as the main connection element between the wooden components, which makes the boxes difficult to open and preventing their repeated use in good conditions for a new shipment.

3) In many cases, although there are good packing systems, there are problems in their storage when they are not in use, i.e. systems that can be reused require large areas for their storage when assembled and empty; this significantly increases the operational costs of the sector.

4) In the packing and transportation of works and objects of art, as well as in the sector of decorative and antique objects, the problem is more complex, since art objects are not massively produced elements under dimension and shape standards. The demand for packing materials in this sector requires that each work or object be packed under individual specifications, creating very complex and costly problems, such as manufacture of special packing for each work or object; demand for space for the storage of boxes inside or outside museums and galleries while the works are on display; if there is no space inside these institutions, it must be purchased outside, and one must pay for transport etc. All this is due to the fact that there are no economic modular packing systems on the market, which can be easily assembled, disassembled, expanded in either direction, so as to adapt to various dimensions, and be reusable.

Various attempts have been made to construct a modular packing crate. However, these systems have complex joining features, and cannot be expanded in size without strict limitations. Furthermore, these systems do not provide for a hollow container without spatial interruption by internally positioned tops and bases of intermediate receptacles within a stack of receptacles.

DISCUSSION OF THE PRIOR ART

U.S. Pat. No. 3,306,487 of Gregoire covers a container based on the junction of metallic panels in its corners, by dove tail joints. These panels cannot have their sides joined axially, but can only be joined perpendicularly, i.e. at approximately 90 degrees, through pre-formed elements, which system does not require external or additional connectors. This makes the container extremely rigid, with no possibility of being extended on any of its sides.

U.S. Pat. No. 3,371,816 of Ricci covers a container with pre-formed plastic panels, joined by counter-positioning their sides, and being locked at the base and on the upper side by guides, located on the panel which forms the base and upper lid, the guides completing the locking and shape of the container. There are no external connectors in this container.

U.S. Pat. No. 3,561,633 of Morrison covers a common rigid container for general cargo, which cannot be dismantled because the joints between its panels, and its structural metallic profiles are welded with expanded polyurethane, which makes this container a monolithic piece. It does not have external connectors, and therefore it cannot be dismantled nor expanded U.S. Pat. No. 3,618,633 of Dobberkau covers a container which, in reality, cannot be dismantled, but can be folded, and which was designed to satisfy a certain demand of the air cargo business. Its connecting elements are hinges, and as for the use of twist-lock connectors, in reality the container does not have this property, since these parts 9*a* and 9*b* are simple clips or fasteners of plastic curtains 9.

Since it is not modular, this system does not allow expansion.

U.S. Pat. No. 3,809,278 of Cmusrik covers a container composed of panels united with a base panel by angular flanges which, when in vertical position, are hooked together through elements inside the channels and then, the four panels in this position are locked in their upper corners by a handle in the shape of an inverted U; in one position, the latter maintains the panels united under pressure, and in another position releases them. It does not require any exterior connecting element, after the lid is placed on top.

The channels or guides shown in the base panels, into which the lateral panels of the Cmusrik '278 patent fit, have a different function than the guides which maintain the base panels in the present invention. In contrast to Cmusrik '278 in the present invention, the guides have the function of maintaining the vertical panels in their position, i.e. they work structurally to avoid horizontal displacement of the panels; but in the Cmusrik '278 container, they work structurally as a connecting element. In the present invention, this function is cleary reserved for connectors.

The Cmusrik '278 patent does not allow expansion or modification of the dimensions of the package container.

U.S. Pat. No. 3,985,258 of Quigley covers a container manufactured of elements of pre-formed plastic, with four equal sides, interlocked perpendicularly at the corners, and connected by a connecting element of the twist-lock type.

The design and principle of the Quigley '258 connector are completely different than the connectors used in the present invention. In the former, the male part must be turned to make it lock inside the space left by the female part; in the Applicant's system, the connectors are based on the central sphere principle, where the female part turns to lock the head of the male part or bolt. Both connectors are known commercially, the first being the so-called Dzus, sold by Dzus Fastener Co., illustrated in U.S. Pat. No. 1,955,740; as well as the Minifix System RTA Fittings, sold by Hafele America Co.

As for the design of the Quigley '258 container, the lateral panels or walls are an integral part of its skids, i.e. the floor panels meet the lateral ones perpendicularly at the level of the action supporting the entire weight of the container. This system does not allow axial connection of its elements.

U.S. Pat. No. 4,730,746 of Yankoff does not concern a container, but a cover for machinery, easy to assemble and disassemble. The rubber joints used are for absorbing the vibrations of the machine in operation. The only connecting elements present are four screws that lock two of the lateral walls to the floor.

U.S. Pat. No. 4,471,449 of Bersani covers a structural profile system, with which one can create tridimensional modules, open in either direction, connected vertically with a prismatic element and horizontally by the same prismatic element, doubled. As can be seen this proposal is the structure for the assembly of the container, which can be used open or without lateral partitions, to facilitate loading and unloading of heavy equipment and machinery; or with lateral partitions, for the protection of smaller palletized merchandise. Regardless of the alternative used, the container can be disassembled, but the enormous size of the panels remains, making its handling difficult for return and storage.

In this patent, like in Quigley '258, a connector of the twist-lock type is used (in fact, here a quarter-turn is used), with a similar principle as that of the aforementioned Quigley '258 patent, namely a sphere divided in two, with the parts separated by an axle which, in turn, is perpendicularly joined to an external metallic bar; when the latter is turned a quarter of a turn, it makes the half-spheres turn, positioning them so as to lock the structural elements of the container, which then cannot be released to another position, and so connect between themselves.

The Bersani '449 connector system allows vertical and horizontal connection to assemble the structure of a container, as well as connection of the structures of two containers between themselves.

U.S. Pat. Nos. 3,311,231 of English; 2,781,902 of Smithers; 4,699,282 of Farrar; and 4,828,115 of Wiegand cover packing designs for specific products, using injected plastic. These patents basically use the concept of packing that protects the object, and subsequently some of these packing materials are packed inside containers.

The aforementioned patents differ from the present invention.

Specifically, in the sector of packing and transport of works of art, for example, intelligent and rational use of styrofoam or polystyrene sheets allows packing more than one work in one sheet, for subsequent packing in the container; for this purpose, containers that can be disassembled and reused as in the present invention are highly efficient and economic, due to the fact that traditional wooden boxes or containers (with nails, glue and screws) must have additional internal elements to adapt them to the various dimensions of the works, and afterwards cannot be used for works with other dimensions.

In the present invention, the packing material is styrofoam, which is not part of the boxes, i.e. the panels making up the boxes will always be free of any additional packing material.

With the exception of Ricci '816, none of the aforementioned patents show the possibility for axial connection between the panels of the containers, since they are based on connection by a single type of connector, with the exception of U.S. Pat. No. 4,741,449, which uses a simple prism for the connections forming the structures of the containers, and a double prism for the connections between containers, but not between their completing panels.

In Ricci '816, the panels may be axially connected, but only with the additional presence of the intervening horizontal floor and top panels of the stacked receptacles. The entire stacked receptacles may be vertically stacked, but the exterior vertical panels cannot be added without also adding the perpendicularly placed horizontal top and bottom panels, thereby interrupting the internal space. This interruption of space prevents a continuous hollow interior, as is shown in the present invention.

Also Ricci '816 shows that the receptacles have complicated interlocking grooves within the panels which limits their construction and interchangeability. The connections in Ricci '816 are between the top of lower receptacle below a corresponding upper receptacle and the floor of the corresponding upper receptacle above it. The connections are not of the vertical walls themselves.

According to all the aforementioned patents, the connectors used in the present invention are different than those used in the patents based on twist-lock connectors.

The connector system Minifix System of RTA sold by Hafele America Co. has never been used for an application of this type, especially with modifications of the use specifications given by the company.

Although the Ricci '816, Cmusrik '278, Yankoff '746 and Gregoire '497 patents start from the same construction principle, assembly and disassembly, all require placement of a horizontal lid for the structural completion of the box or container; the base panels and roof or lid are connectors themselves, not requiring the use of external connectors. This further limits the interior space of the stacked containers, preventing a continuous hollow interior, as discussed specifically with respect to Ricci '816 above.

From 1964 to 1988, knock-down container systems were proposed, which are supposedly efficient and solved existing and new requirements for packing, boxing and transport of products such as works of art, antiques, historic objects and documents, medical equipment, electronic equipment, computers, laboratory equipment, measurement instruments, etc. Yet, the goal was not achieved.

All previous patents related to this idea are limited in their possibility of changing dimensions in either direction, so as to adapt to users, needs. Those made of premolded plastic, as well as others, which are not satisfactory in their design principles, are deficient as far as storage and transport are concerned.

SUMMARY OF THE INVENTION

With the present invention, one can build knock-down containers whose panels can be divided into smaller modular panels, facilitating their use and even building up into larger containers with large, hollow interior spaces to accommodate large objects for packing and shipping. On the other hand, any damage incurred during use can be remedied by replacing only the damaged panel and not the container.

In this frame of reference, the packing system under this invention was created and designed to solve all these shortcomings of the current packing sector, due to its special characteristics.

The system proposed is based on the connection of modular panels, generally made of wood, approximately 19 mm thick, by using metallic centric sphere connectors "Minifix 15" manufactured by the company Hafele America Co., and guides or spaces made in the panels, in order to structurally reinforce the joints between them, guaranteeing their sealing through the use of rubber joints placed along said guides or channels, which also serve as guides for easy assembly of the boxes. The wood is generally hardwood plywood, with a hardwood core, such as APPLEPLY® plywood. It is contemplated that the panels could be made of plastic or metal, with or without hollow, honey-combed supported walls.

This packing system allows building modular boxes, which are disassembled by a simple half-turn of the female part, which releases the head of the connector. These boxes can expand in either direction, by adding modular panels making up the system, and by using connectors with one head for perpendicular connection and a connector with two heads in axial or longitudinal connections; such joints are reinforced with overlapping wooden elements, which are placed on same.

As for the design of the boxes, there are two types of boxes: those that can be opened in the upper part, and those which can be opened on two sides, as vertical doors.

This system is not limited as far as dimensions are concerned, except for limitations due to handling restrictions, when they are transported by any conventional transport means.

In the boxes that open on the top, the six panels making them up have the following configuration of structural guides or channels: floor and roof (lid) panels have four guides; lateral panels have two guides; and the front and back panels (connecting panels), or fore panels, have no guides.

The boxes that open by one of their sides, have the following guide configuration: the base or floor panel has four guides; lateral panels (connecting panels) do not have guides; the top or roof panel has two guides; and the front panels (lid or door) and the back panel have three guides.

As a complement of the system, the use of rubber foam of various densities of polystyrene (especially "Ethafoam" from Dow Chemical Company) in the primary packing stage, allows designing packing depending on the shape and specifications of the object, related to the size and shape of the boxes. This guarantees enormous flexibility to the system, which adapts to various requirements.

DESCRIPTION OF THE DRAWINGS

For the purpose of clarity, the invention is illustrated in the following series of drawings, which represent one embodiment of the invention, given as an example.

In the drawings:

FIG. 11 is a measurement conversion chart of the foregoing dimensions in FIGS. 8, 8A, 9, 9A, and 10A in inches or millimeters.

DETAILED DESCRIPTION OF THE DRAWINGS

The figures show the execution of a knock-down packing system, whose minimum basic elements are modular wooden panels, designated -1-, -2-, -3-, -4- and -5-, of which panel -1- and another twin panel constitute respectively the floor and the roof of the packing box; panels -2- and -3- constitute the larger lateral sides of the box; and panels -4- and -5- constitute the front or fore panels, and the back.

In order to vary the size of the panels, the wall panels depicted -1-, -2-, -3-, -4- and -5-, respectively, may be provided in a plurality of interchangeable panels with incremental dimensional variations, as shown in FIGS. 7, 8, 9, 10 and 11.

Figure 7:
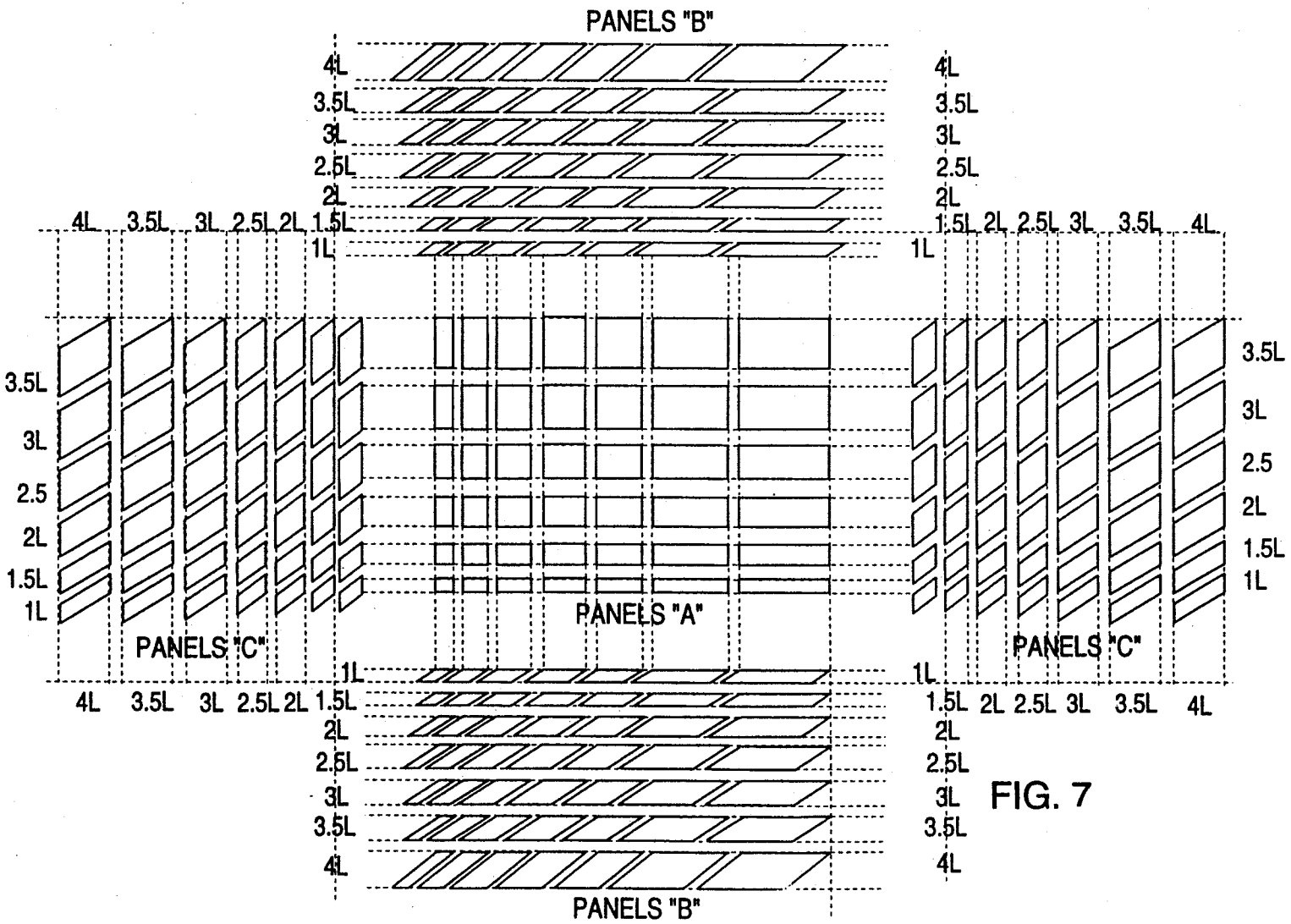
FIG. 7 depicts a plurality of modular wall panel components in an exploded perspective view of the invention.
Figure 8:
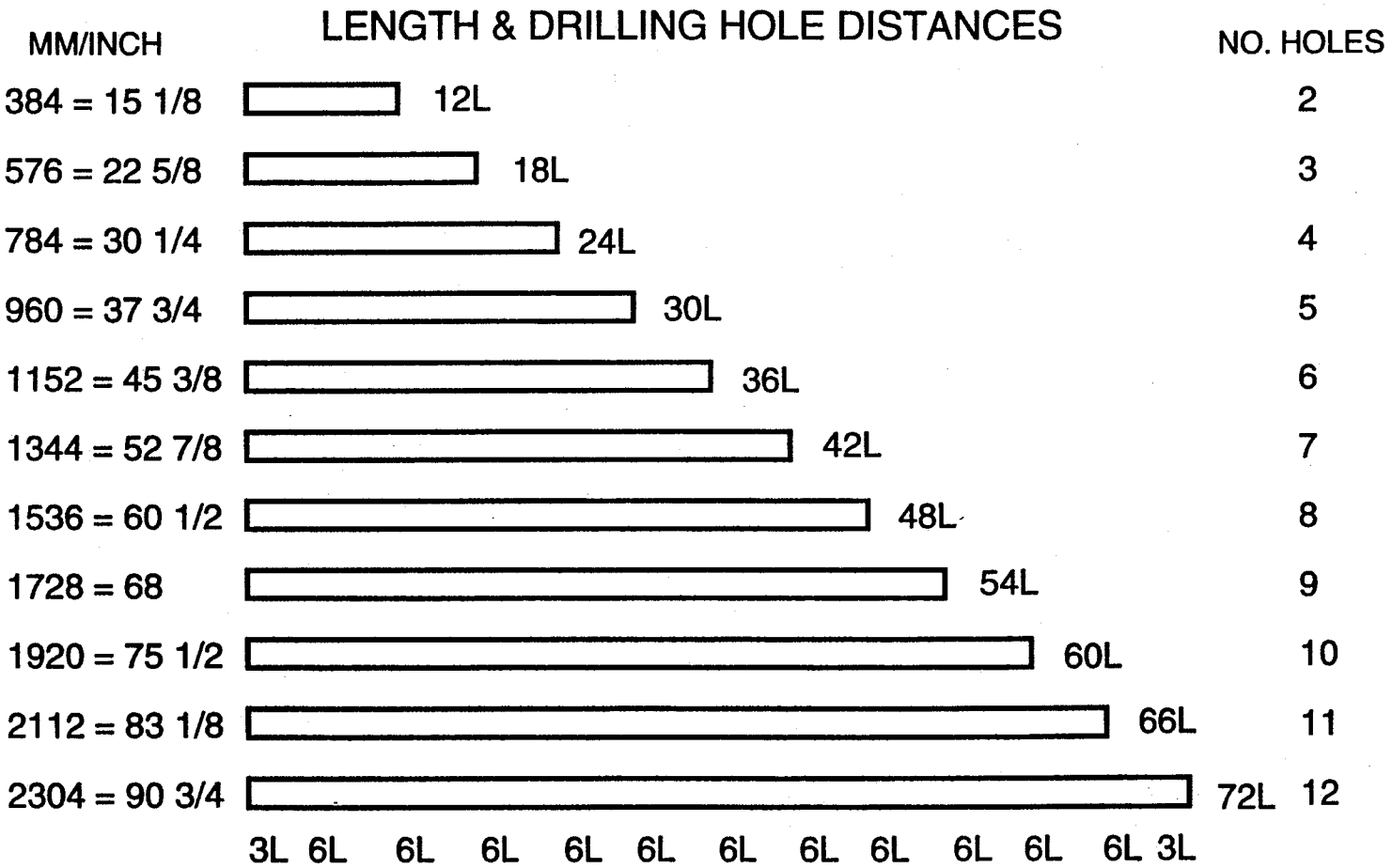
FIG. 8 is a bar graph chart depicting the increasing length sizes of the side panels of one embodiment of the invention.
Figure 8A:
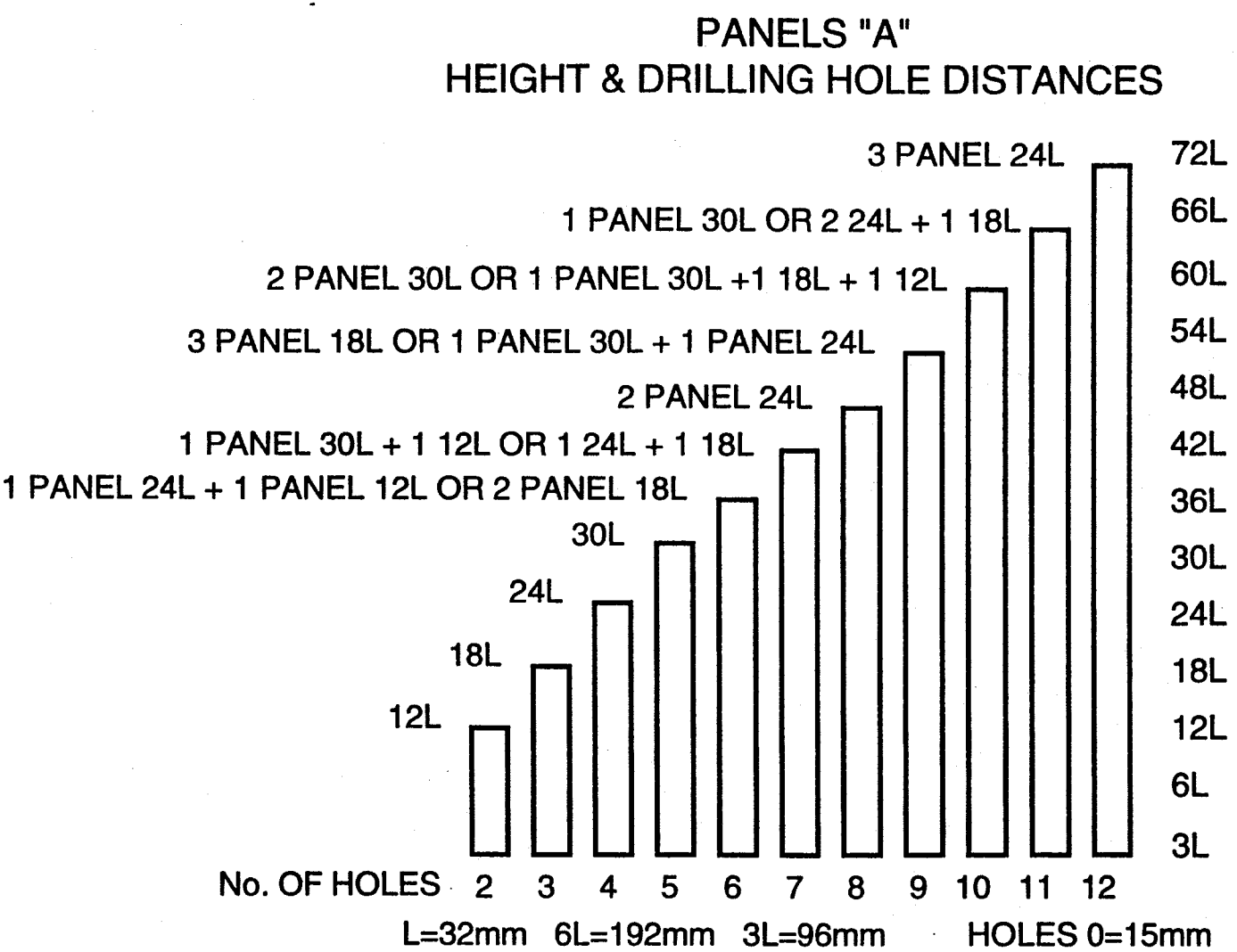
FIG. 8A is a bar graph chart depicting the increasing height sizes of the side panels of one embodiment of the invention.
Figure 9:
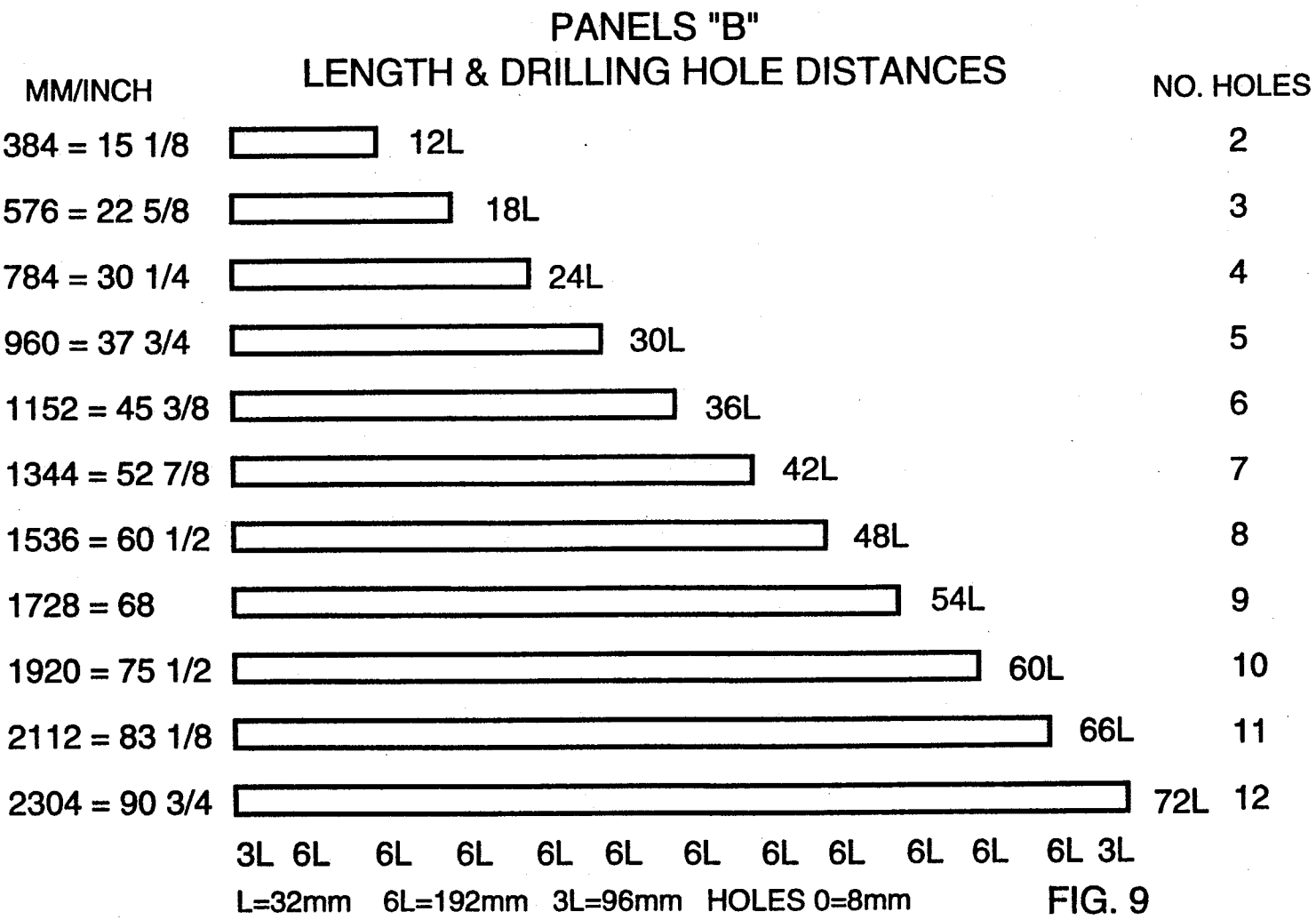
FIG. 9 is a bar graph chart depicting the increasing length sizes of the top and bottom panels of one embodiment of the invention.
Figure 9A:
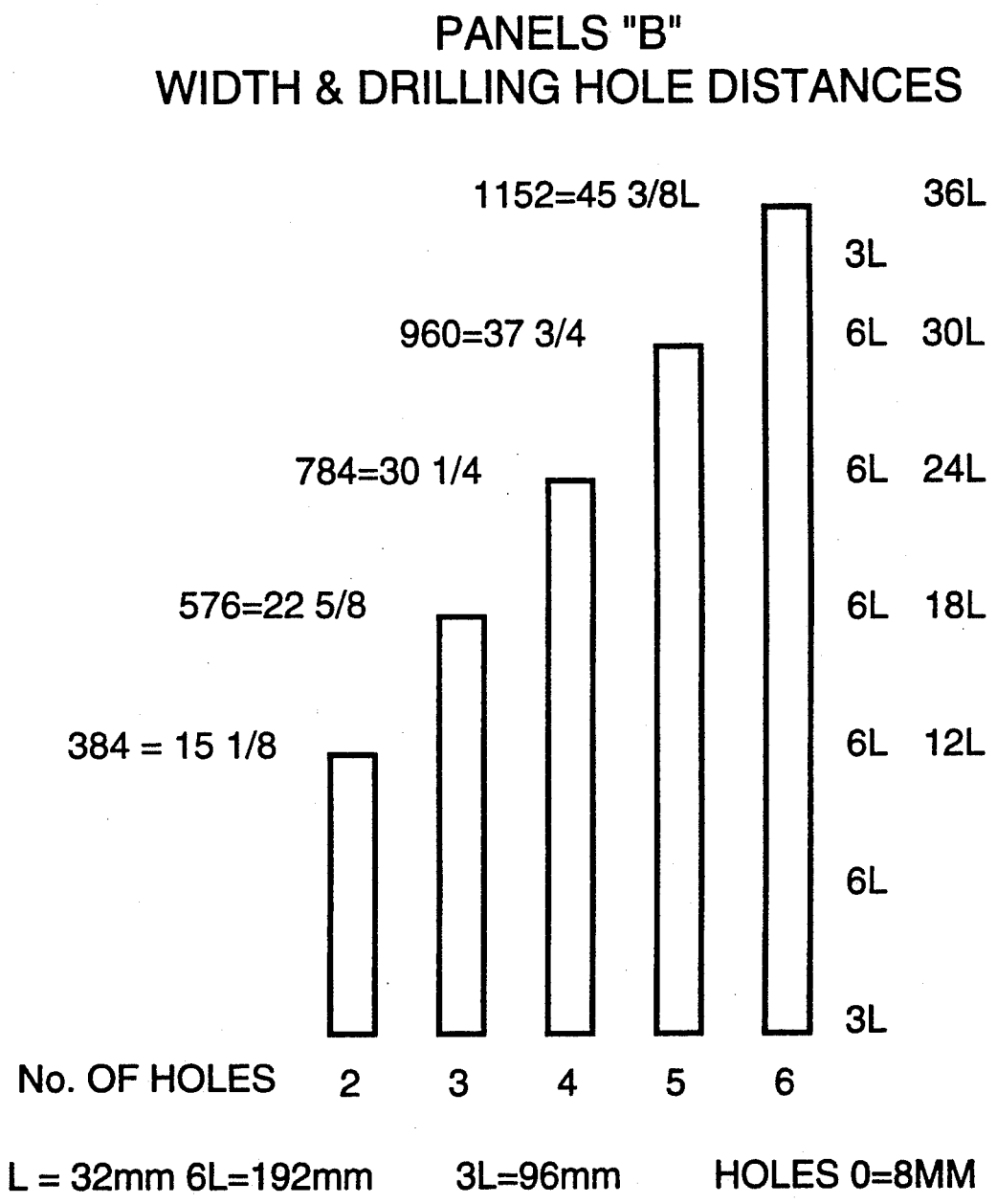
FIG. 9A is a bar graph chart depicting the increasing width sizes of the top and bottom panels of one embodiment of the invention.
Figure 10:
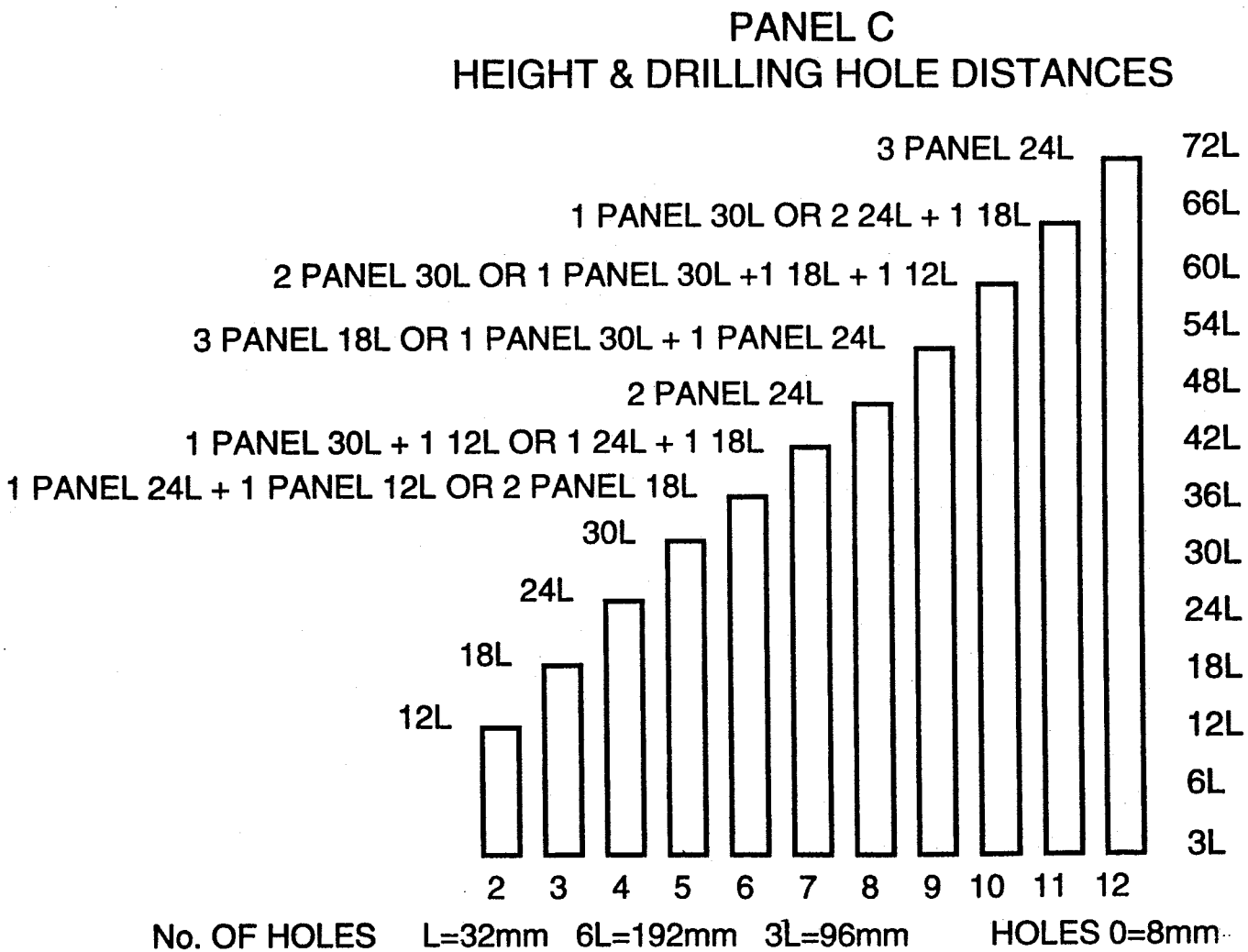
FIG. 10 is a bar graph chart depicting the increasing height sizes of the front and rear panels of one embodiment of the invention.
Figure 10A:
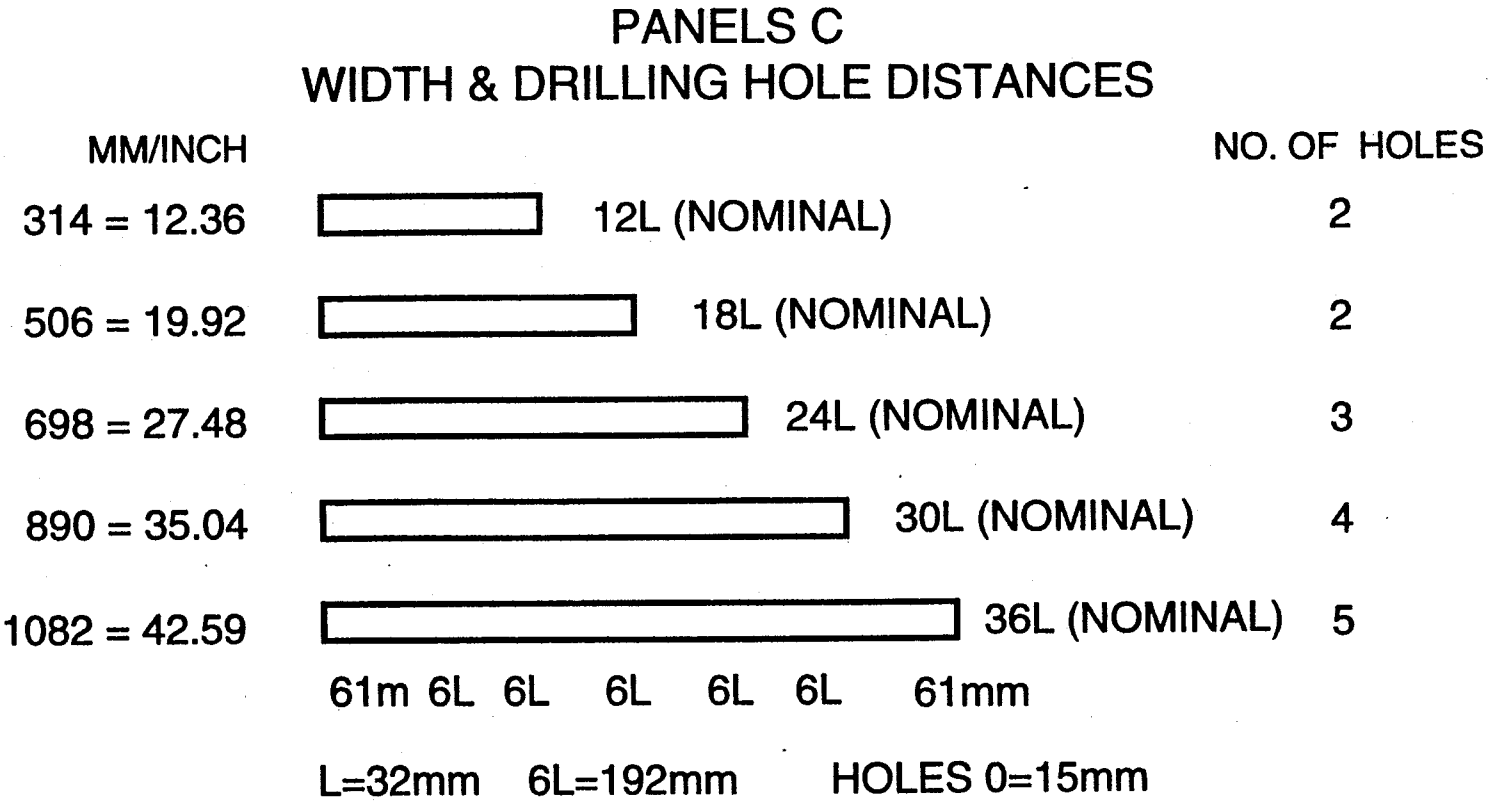
FIG. 10A is a bar graph chart depicting the increasing width sizes of the front and rear panels of one embodiment of the invention.

FIG. 7 depicts the plurality of modular components in an exploded perspective view, with the lateral side panels designated as panels "A," the top and bottom panels designated as panels "B" and the connecting front and rear panels designated as panels "C." In FIG. 7 the front panels are on the left side and the rear panels are on the right side.

As shown in FIGS. 8, 8A, 9, 9A, 10 and 10A the panels A, B, C incrementally increase in length, height and width according to the formula $a=x+x/2$ where x=one unit of dimension size of a panel, which unit of dimension size x is increased incrementally by the addition of x/2 and where a= the next incremental increased size of the next larger panel. The next successive size b of the next panel larger than the preceding panel of length a would be equal to a+x/2 and the following successive size c would be equal to b+x/2. The sizes of the panels increase until z, which panel of size z is equal to the preceding adjacent smaller size panel of size z−1+x/2.

In the present invention, for example, x is chosen to be 12L, where L=a unit of 32 mm. Therefore the next incrementally larger size is 18L, or 18 times 32 mm, such that the second size of 18L=12L+½ (12L).

FIG. 11 depicts a typical measurement conversion chart of the foregoing dimensions in either inches or millimeters.

By using the foregoing formulas for incrementally increasing the size of the panels, a plurality of modular size containers can be constructed suitable exterior and interior to varying dimensional needs of the containers and the products to be shipped.

The connection between panels is obtained by using connectors, such as metallic or plastic centric sphere connectors, depending upon the strength required made up of a male or rod element -6- and by a female part -7-, such as the "Minifix 15" type made by the company Hafele America Co.

In one of their faces, namely on the interior of the space so created, the panels have channels or spaces -8- designed to structurally reinforce the connection between panels, guaranteeing the sealing of the panels through the use of rubber joints -9-, placed longitudinally along said channels, which also serve as guide for easy assembly of th packing boxes.

The boxes obtained with this modular method can be extended in either direction, by adding modular panels forming the system; for this purpose, connectors of the type referenced under -6- are used, with one head **-6*a*- for perpendicular connections, and a connector of the type -10- with two heads -10*a*-** is used for axial connections.

Figure 1:
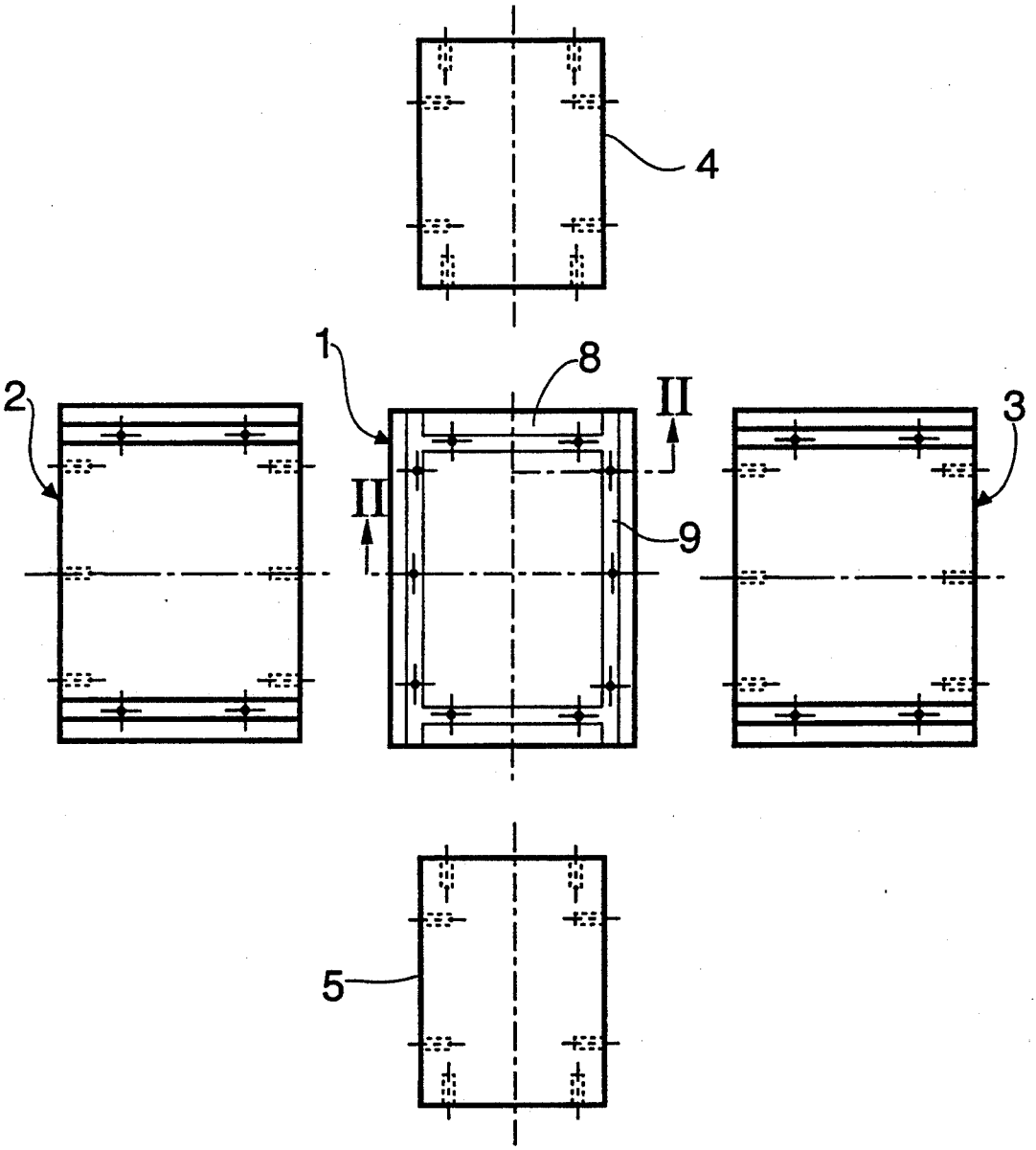
FIG. 1 is an exploded view of the modules composing a simple packing of the type that opens at the top; not showing the representation of the lid module, since it is identical to the floor module.
Figure 2:
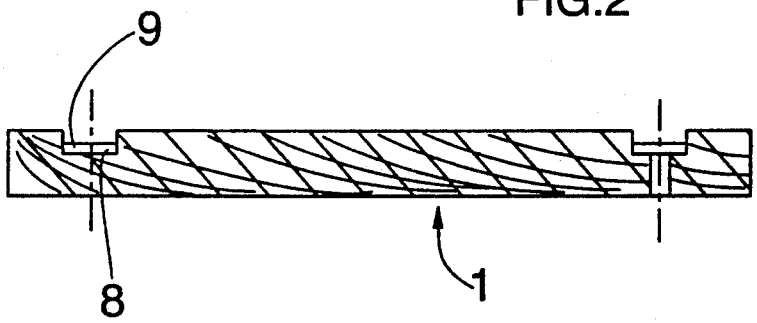
FIG. 2 shows a cross-section of the floor module, seen along line II—II of FIG. 1.
Figure 3:
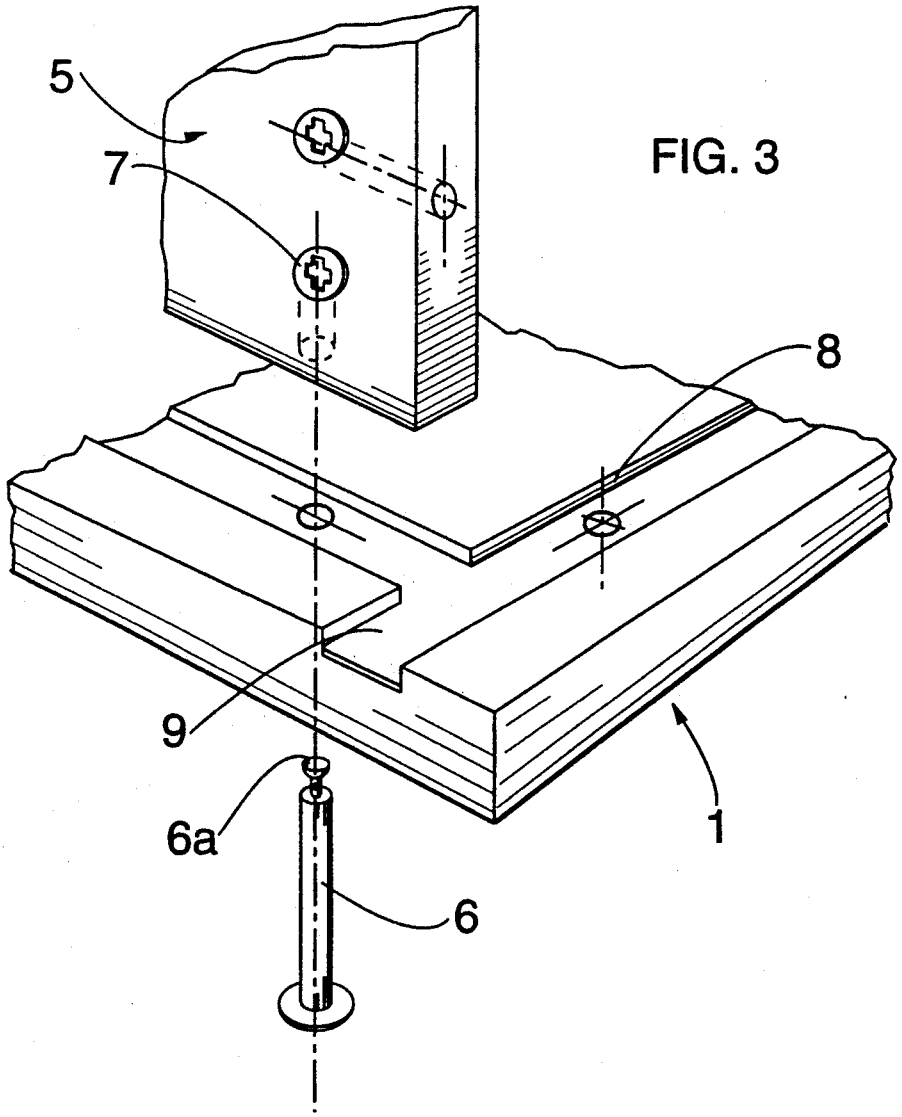
FIG. 3 shows a detail perspective view of the connection system between a floor module or panel and a front module or panel.
Figure 4:
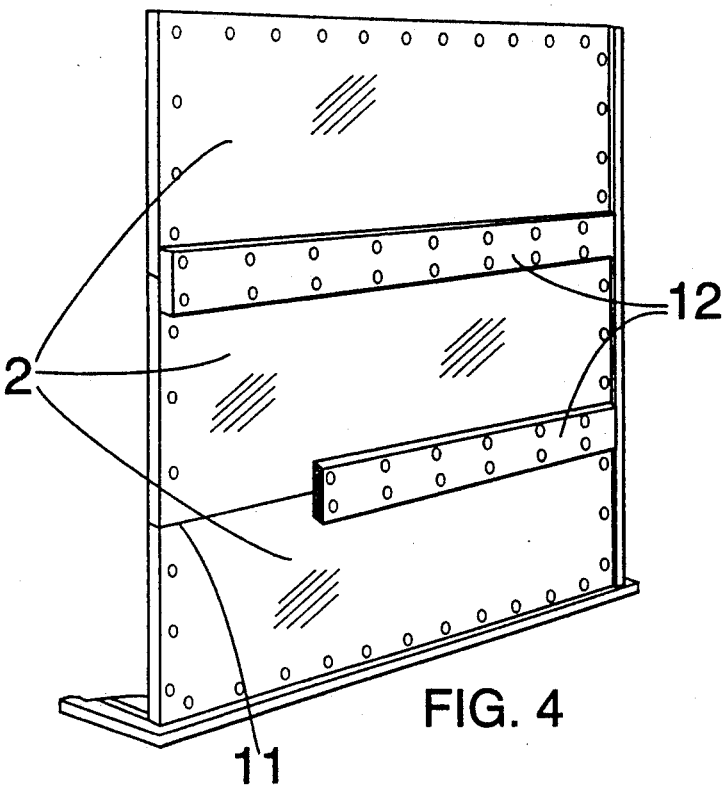
FIG. 4 is a partial perspective view of a packing made of various panels connected through double head connectors which work axially; the corresponding overlapping external wooden elements are shown on the joints between panels.
Figure 5:
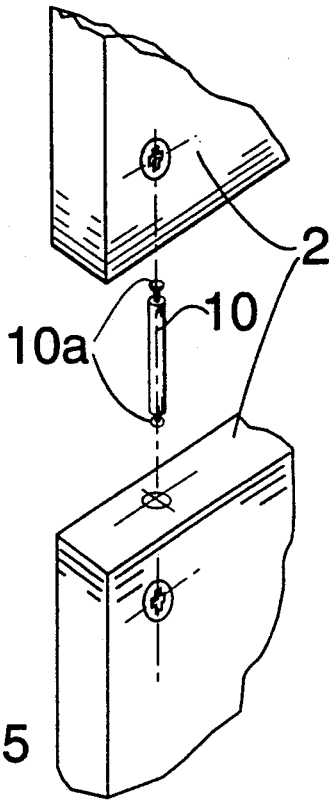
FIG. 5 shows a detail in perspective and in exploded view of an axial connection between two modular panels.
Figure 6:
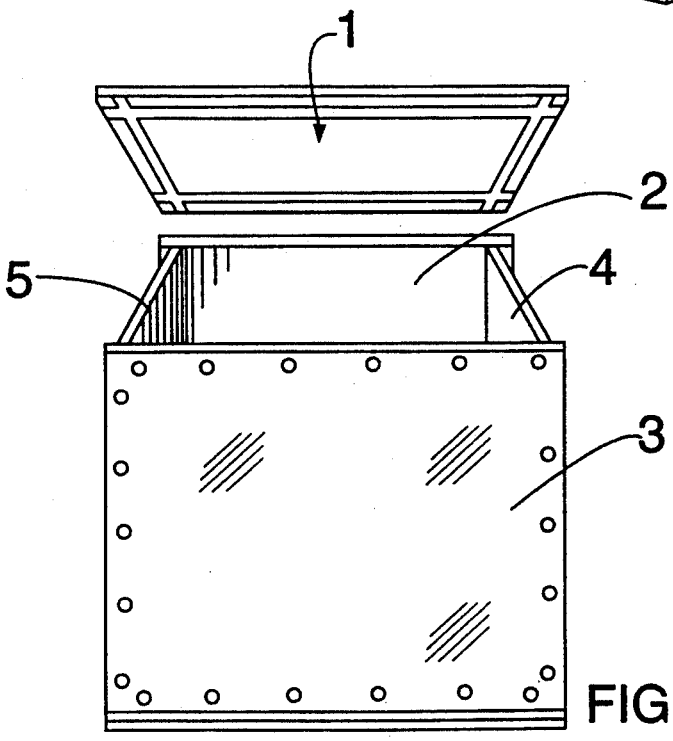
FIG. 6 shows the perspective of a box or packing made under the system of the invention, based on six modular panels.

This type of expansion of the boxes is represented in FIG. 4 and details of FIG. 5. In said FIG. 4, various panels are shown from the side -2-, linked with the rod -10- with double head **-10*a*-, whose resulting joints -11- may be reinforced with optional wooden overlapping elements -12- placed on the exterior. The overlapping elements -12-** are held in place over the joints by means of conventional carriage bolts. The interior edges of which are sunken below the surface of the interior of the panels to maintain a smooth interior panel surface. The longitudinal axis of the expansion plate overlapping elements are parallel to the axis of the joints covered by the expansion elements.

As indicated above, the boxes that may be obtained with the system under the present invention are of two types; those that can be opened on top, and those that can be opened on two sides, like doors.

In essence, the invention can be applied in practice in other forms of execution, with different details than those shows as an example in the description, also supplying the protection sought. For example, the modular components can be constructed on a miniature scale of a child safe material, such as plastic, for a toy set of modular panels with plastic central sphere connectors to enable a child to build varying size geometric assemblages to learn mathematical relationships on a three dimensional scale. In such a case, the panels can be supplied with an original unit size and incrementally larger sizes in accordance with the above relationship of increasing sizes, to enable the child to appreciate varying sizes of construction proportions.

Therefore, the system can be built in any shape and size, with the most adequate materials and means, maintaining the spirit of the claims.

What is claimed is:

1. An improved system of knock-down packing, comprising a plurality of modular components, each of said components made of rectangular panels, each panel joinable to one or more of said panels, which said panels each include assembly channel means and padded locking joining means in said panels, said padded joining means being disposed within said channel means, said padded joining means sealing a plurality of said panels together at straight joints thereof; means for maintaining said panel components stable, said means including connectors, said connectors comprising a rod, acting as male part, and a circular part incorporated in each of said panels, each of said circular parts, acting as a female part, said female part being pivotable a half-turn between a functional position, and a non-functional position for facilitating the disassembly of said panels comprising packing boxes of a straight rectangular prism configuration, said boxes including one or more upper top panels and one or more lower base panels, a plurality of lateral longitudinal panels and one or more front and back panels.

2. The improved system of knock-down packing, according to claim 1, wherein said channel assembly means of said panels comprises one or more channel guides disposed on one side of said panels, which said channel guides are parallel and are placed on at least two opposed sides of one planar surface of said panel; said channel guides including said padded locking joints placed longitudinally within said channel guides.

3. The system as in claim 2, wherein said channels are located coterminus with a plane of said rod of said connectors, said channels being reciprocally grooved to receive another of said panels within said channel, such that said other panel is coterminus with the planar axis of said channel.

4. The system of knock-down packing as in claim 3, further comprising a means to incrementally and proportionately vary linear sizes of said panels, said means including a plurality of said interchangeable wall panels, said panels having equal incremental and proportional dimensional variations of length, height and width.

5. The system of knock-down packing as in claim 4, wherein each of said panels vary in height, length and width from other of said panels by incremental sized increased dimensions in equal proportion to each other of said panels, said dimensions designated x, a, b, c, etc. to z according to the following formula:

$a=x+x/2,$ where X=one first unit of linear size, which said unit of size x is increased t a next size a incrementally by the addition of x/2, such that a=x+x/2, b=a+x/2, c=b+x/2 until size z, which said unit size z=z−1+x/2.

6. The system as in claim 3, wherein said other panels being received into said reciprocally grooved channel guides of said panels have no channel guides.

7. The system as in claim 6, wherein each of said panels have four edges, said upper top panels and said lower base panels each have four channel guides, said two lateral sides each have two channel guides and said front and back panels have no guides, said front and back panels reciprocally being received at all four of said edges of said front and back panels into corresponding channel guides of said corresponding upper top panel, said lower base panel and said two lateral side panels.

8. The system as in claim 6, wherein said lower base panel has four channel guides, said lateral side panels have no guides, and the front and back panels each have three channel guides, said lateral side panels reciprocally received at all four edges into corresponding channel guides of said corresponding connecting panels.

9. The invention as in claim 2, further comprising a means for sealing said panels, said sealing means comprising said padded locking joints being placed longitudinally within said channel guides and said padded locking joints being made of sealant material.

10. The invention as in claim 9, wherein said padded locking joints are rubber.

11. The system as in claim 2, wherein said channel guides are located coterminus with a plane of the rod of said connectors, said channel guides being reciprocally grooved to receive another of said panels within said channel guide, such that the said other panel is coterminus with the planer axis of said channel guide.

12. The system of knockdown packing as in claim 1, further comprising a means to facilitate the said expansion of said packing in three dimensional directions through the axial coplanar addition of similar modular panels, said means comprising said connectors connecting said panels axially, said connectors provided with one head for straight joints and two heads for axial and coplanar joints.

13. The system of knock-down packing, according to claim 12, further comprising longitudinally extending overlapping elements reinforcing joints between two axially connectable adjacent panels, said overlapping elements being plates locatable externally over said joints, the longitudinal axis of said plates being parallel to the axis of said joints, and said overlapping elements being located on both of said adjacent panels.

14. The system as in claim 1, wherein said panels are wooden.

15. A miniature modular component toy system, comprising a plurality of modular components, each of said components made of rectangular panels, each panel joinable to one or more of said panels, which said panels each include assembly channel means and padded locking joining means in said panels, said padded joining means being disposed within said channel means, said padded joining means sealing a plurality of said panels together at straight joints thereof; means for maintaining said panel components stable, said means including connectors, said connectors comprising a rod, acting as male part, and a circular part incorporated in each of said panels, each of said circular parts acting as a female part, said female part being pivotable a half-turn between a functional position, and a non-functional position for facilitating the disassembly of said panels comprising packing boxes of a straight rectangular prism configuration, said boxes including one or more upper top panels and one or more lower base panels, a plurality of lateral longitudinal panels and one or more front and back panels.

16. A miniature modular component toy system, according to claim 15, wherein said channel assembly means of said panels comprises one or more channel guides disposed on one side of said panels, which said channel guides are parallel and are placed on at least two opposed sides of one planar surface of said panel; said channel guides including said padded locking joints placed longitudinally within said channel guides.

17. The system as in claim 16, wherein said channels are located coterminus with a plane of said rod of said connectors, said channels being reciprocally grooved to receive another of said panels within said channel, such that said other panel is coterminus with the planar axis of said channel.

18. The system of knock-down packing as in claim 13, further comprising a means to incrementally and proportionately vary linear sizes of said panels, said means including a plurality of said interchangeable wall panels, said panels having equal incremental and proportional dimensional variations of length, height and width.

19. The system of knock-down packing as in claim 18, wherein each of said panels vary in height, length and width from other of said panels by incremental sized increased dimensions in equal proportion to each other of said panels, said dimensions designated x, a, b, c, etc. to z according to the following formula:

$$a=x+x/2,$$

where X=one first unit of linear size, which unit of size x is increased to a next size a incrementally by the addition of x/2, such that $a=x+x/2$, $b=a+x/2$, $c=b+x/2$ until size z, which said unit size $z=z-1+x/2$.

20. A miniature modular component toy system as in claim 15, further comprising a means to facilitate the expansion of said packing in three dimensional directions through the axial coplanar addition of similar modular panels, said means comprising said connectors connecting said panels axially, said connectors provided with one head for straight joints and two heads for axial and coplanar joints.

21. A miniature modular component toy system, according to claim 20, further comprising longitudinally extending overlapping elements reinforcing joints between two axially connectable adjacent panels, said overlapping elements being plates locatable externally over said joints, the longitudinal axis of said plates being parallel to the axis of said joints, and said overlapping elements being located on both of said adjacent panels.

22. The system as in claim 15, wherein said panels are wooden.

23. The miniature modular component as in claim 15, further comprising a means for creating different shaped forms, said means including connectors having a plurality of rod members, said panels axially connected in any degree between 1° and 90°.

24. The miniature modular component toy system as in claim 23, wherein said panels are axially connected by flexible hinge members.

* * * * *